US005865424A

United States Patent [19]

Lutz et al.

[11] Patent Number: 5,865,424

[45] Date of Patent: Feb. 2, 1999

[54] SCISSORS JACK GEAR TOOTH DISENGAGEMENT PREVENTION SYSTEM

[75] Inventors: Jay H. Lutz; Matthew E. Buchanan, both of Fort Wayne, Ind.

[73] Assignee: Universal Tool & Stamping Co., Inc., Butler, Ind.

[21] Appl. No.: 917,214

[22] Filed: Aug. 25, 1997

[51] Int. Cl.[6] ..... B66F 3/08

[52] U.S. Cl. ..... 254/126

[58] Field of Search ..... 254/122, 126, 254/DIG. 1

[56] References Cited

U.S. PATENT DOCUMENTS 4,055,329 10/1977 Hammond ..... 254/126
5,139,232 8/1992 Bailey ..... 254/126

*Primary Examiner*—Robert C Watson
*Attorney, Agent, or Firm*—Hill & Simpson

[57] ABSTRACT

A scissors jack has first and second upper channels having first and second opposite ends and joined by first and second pivot pins to a load bearing member at the first ends. First and second lower channels have first ends joined to the second ends of the first and second upper channels at third and fourth pivot pins, and second ends of the first and second lower channels are joined by fifth and sixth pivot pins to a base having a floor portion and upwardly extending side-walls. Gear teeth are formed at opposite side walls at the second ends of the first and second lower channels and which intermesh at an engagement region between the fifth and sixth pivot pins. A screw has one end received through an aperture associated with the third pivot pin, and an opposite end is received in a threaded aperture associated with the fourth pivot pin. First and second support tabs are provided directly adjacent the lower channel gear teeth at the engagement region of the teeth of the first and second lower channels so that the teeth in the engagement region are closely sandwiched between a flat supporting surface of the respective support tab and an inside of the respective side-wall of the base, so that misalignment of the teeth at the engagement region caused by high loads is substantially prevented.

12 Claims, 4 Drawing Sheets

SCISSORS JACK GEAR TOOTH DISENGAGEMENT PREVENTION SYSTEM

BACKGROUND OF THE INVENTION

Scissors jacks for raising automotive vehicles or other loads away from the ground are known. Such scissors jacks carry extremely heavy and bulky loads compared to their relatively small size. An example of such a prior art scissors jack is shown in FIG. 1 at 10.

Typically the scissors jacks have two upper channels 11 and 12 joined together by pivot pins 8 and 9 to a U-shaped load bearing member 13. At ends of the U-shaped channels 11 and 12 meshing gear teeth 19 and 20 or 19*a* and 20*a* are provided. Lower channels 14 and 15 respectively connect to the upper channels 11 and 12 by pivot pins 7 and 8. The lower channels 14 and 15 also have gear teeth 17 and 18 which intermesh. The lower channels 14 and 15 are connected to an approximately U-shaped base 16 by respective pivot pins 26 and 27 passing through side walls 33 and 34 of the base 16. A threaded screw 22 having one end passing through a central portion of a pivot pin 8 has at that end a crank arm 5 and at the opposite end a threaded engagement in threaded opening 21*a* of a nut 21*b* in extended member 21 connected at pivot pin 7. The scissors jack is thus raised and lowered by cranking the crank arm 5.

FIG. 2 shows a top view of the base 16 and the details of engagement of the gear teeth 17 and 18 at one side of the lower channels 14 and 15 and similar gear teeth 23 and 24 engaging at the other side of the lower channels 14 and 15.

When large bulky loads are placed on the load bearing member 13, frequently a twisting action can occur due to unbalance of the load. This twisting action can cause the teeth such as 18 or 24 to disengage from the respective teeth 17 or 23 as shown by the dashed lines at 18', 24' and 17', 23'. This can cause failure of the jack, an obviously dangerous situation where large loads are involved, such as for an automotive vehicle. Such failure might occur while a user of the jack is changing a tire on the automotive vehicle, for example. Also, failure might occur while the user is raising the jack.

In one attempt at a prior art solution to the above described problem, a stamped steel tubular spacer or a piece of steel tubing was placed around the pivot pins 26 and 27 as shown in dashed lines at 3 and 4 in FIG. 2, in an effort to prevent the gear teeth from deforming in an inward direction during extreme loading. However, such an approach adds significant cost and a very significant constructional complexity to the jack assembly.

In another prior art approach to solve the problem, it has been known to form extensions from one sidewall of the lower channels to act as a spacer as shown at 1 and 2 in FIG. 2, also in dashed lines. However, there is the disadvantage with such an approach that it does not securely prevent deformation of the teeth and also most importantly requires a complicated manufacturing method to form such extensions on the one sidewall of the lower channels.

SUMMARY OF THE INVENTION

It is an object of the invention to substantially reduce the danger of jack failure due to disengagement of jack teeth on the lower channels of a scissors jack, and to do so with a structure which is low in manufacturing cost, reliable, and easy to assemble.

According to the invention, a support tab is provided upwardly extending from the base such that the gear teeth on the lower channels at an engagement region are sandwiched between the respective support tabs and outer walls of the base. The support tabs substantially prevent disengagement of the lower channel teeth when a twisting load occurs on the scissors jack. Preferably the support tabs have a trapezoidal configuration with a flat main supporting surface, and bent flanges for strengthening the main supporting surface. The support tabs are preferably created by a relatively simple stamping operation such that they are cut free from the base and can be bent upwardly and shaped to the desired configuration described above.

DESCRIPTION OF THE PREFERRED EMBODIMENTS

Figure 1:
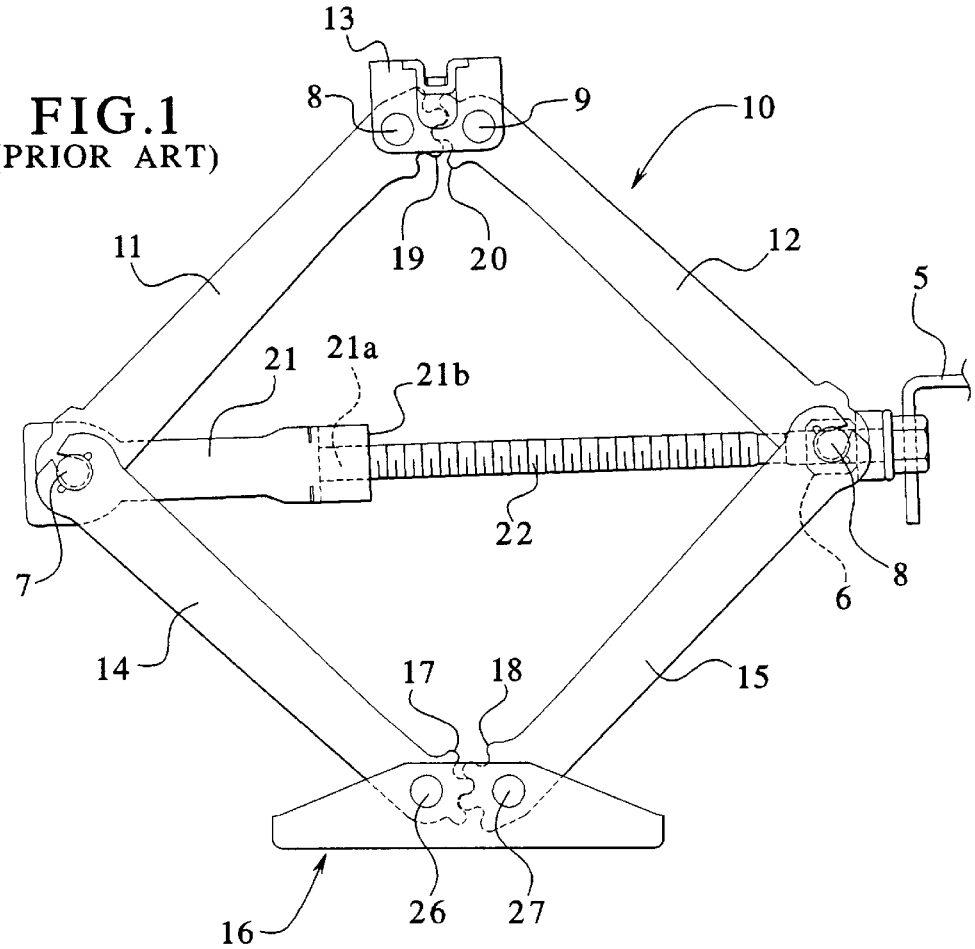
FIG.1 (PRIOR ART)
FIG. 1 is a side view of a prior art scissors jack.
Figure 2:
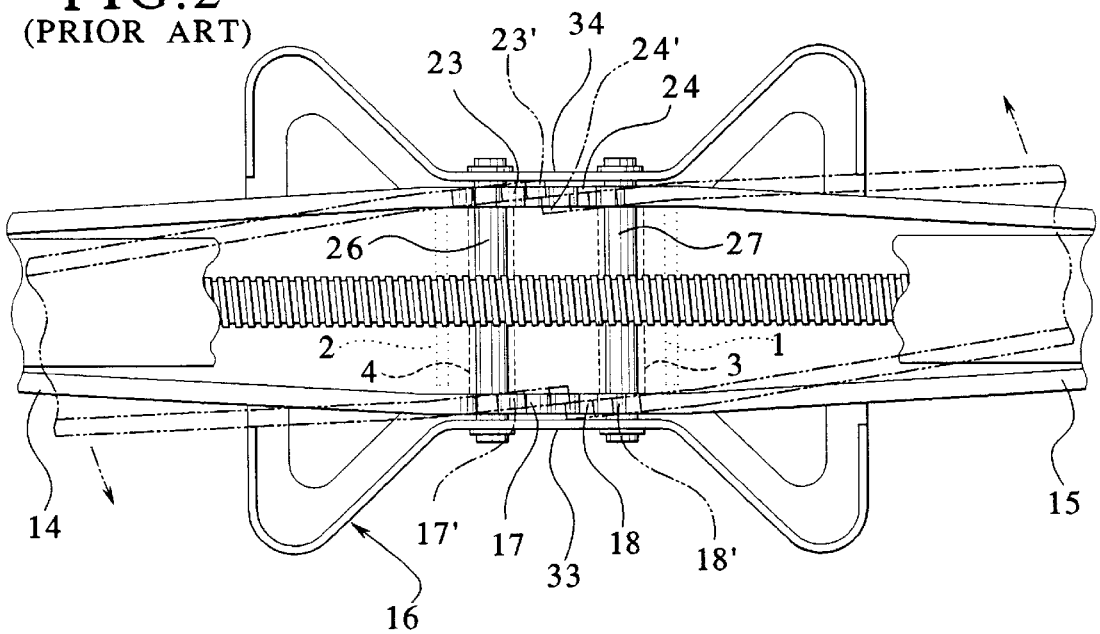
FIG.2 (PRIOR ART)
FIG. 2 is a top view of the prior art scissors jack of FIG. 1 showing the base portion thereof in detail.
Figure 3:
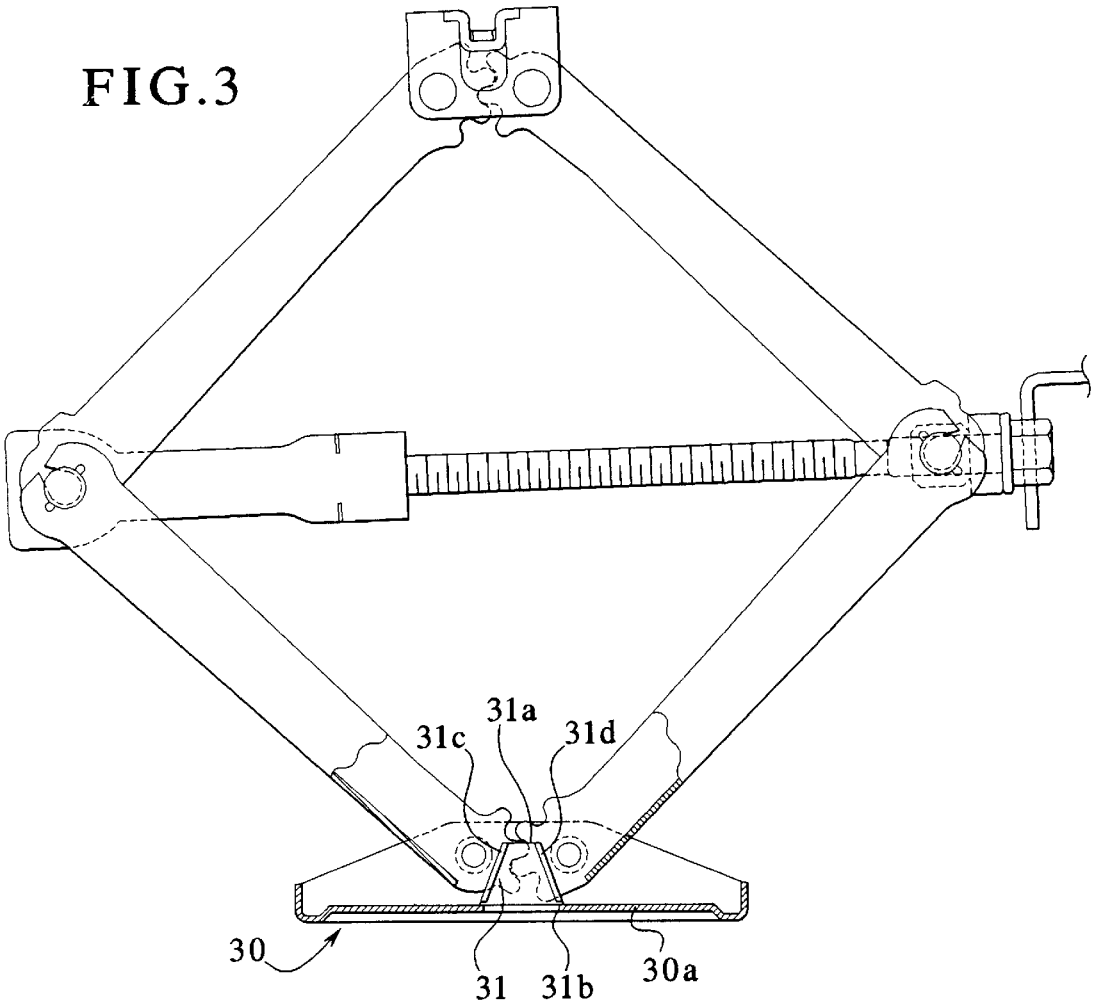
FIG. 3 is a side partially cutaway view of the scissors jack of the invention having a gear tooth disengagement prevention system.
Figure 4:
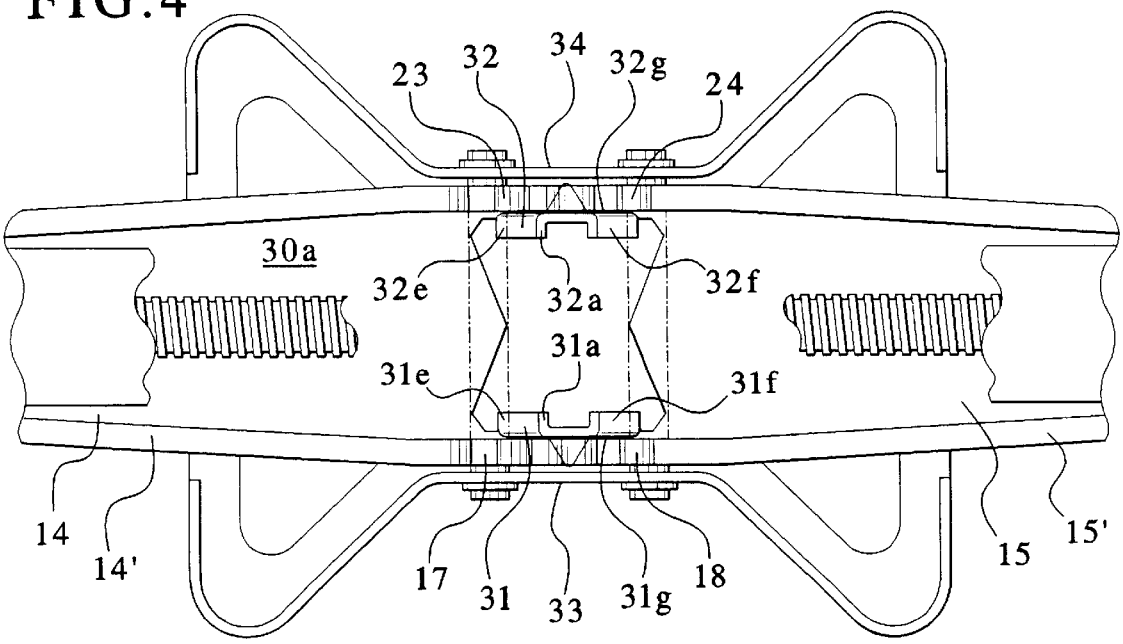
FIG. 4 is a top view of the base portion of the inventive scissors jack of FIG. 3.
Figure 5:
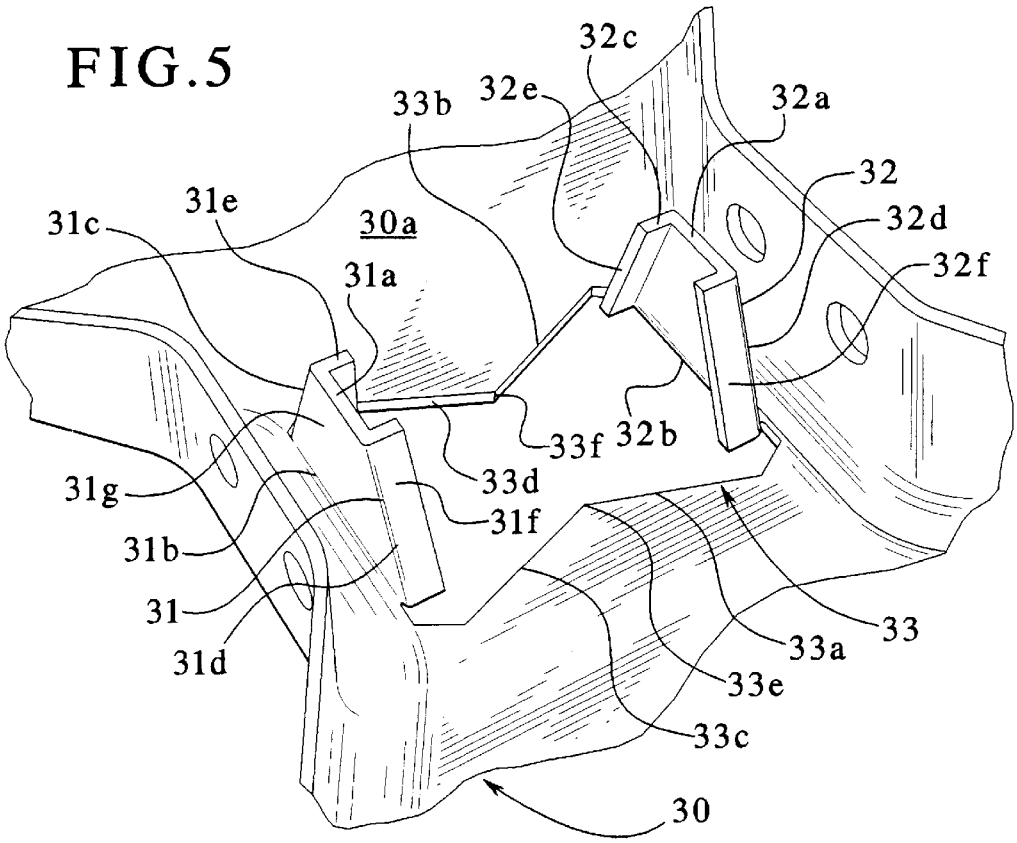
FIG. 5 is a perspective view from the top of the base of the scissors jack of the invention.

According to the invention and with particular reference initially to FIGS. 3 and 4, an improved base 30 of the invention has support tabs 31 and 32 integrally formed to, and projecting upwardly from, a floor portion 30*a* of the base 30. These tabs are trapezoidal in shape as shown in FIG. 3 and FIG. 5 such that they have an upper narrower top edge 31*a*, 32*a* which is narrower than the base portion 31*b*, 32*b* and sloping sides 31*c*, 32*c* and 31*d*, 32*d* which each respectively merge into flanges 31*e*, 32*e* and 31*f*, 32*f* shown most clearly in FIGS. 4 and 5. The tabs 31, 32 for example, thus have flat support surfaces 31*g*, 32*g* which support and guide the gear teeth 17 and 18, or 23 and 24, of the lower channels 14 and 15 between these flat support surfaces 31*g*, 32*g* and the inside of the outer side walls 33 or 34 of the base 30. The tabs are located such that the support surfaces 31*g*, 32*g* are spaced from the inside of the side walls of the base slightly greater than a thickness of the gear teeth. Preferably the gear teeth 17, 18 and 23, 24, as is the case with gear teeth 19, 20, are formed on a respective bent over flange on each of the channels 14, 15, 11, 12 so that the gear teeth have a defined lateral extent based on the width of the flange on which the gear teeth are formed. The flanges on the lower channels are shown at 14' and 15' in FIG. 4.

The top of the support tab 31 or 32 terminates substantially no higher than the top of the pivot pins 26 and 27 so that the gear teeth will be stopped by the pivot pins in the fully lowered position of the jack, and not by the tabs. Also, the width of the upper end of the tabs at 31*a* or 32*a* is less than a spacing between the pivot pins 26 and 27.

FIG. 5 shows the support tabs employed in the tooth disengagement prevention system of the invention in a perspective view from the top.

Figure 6:
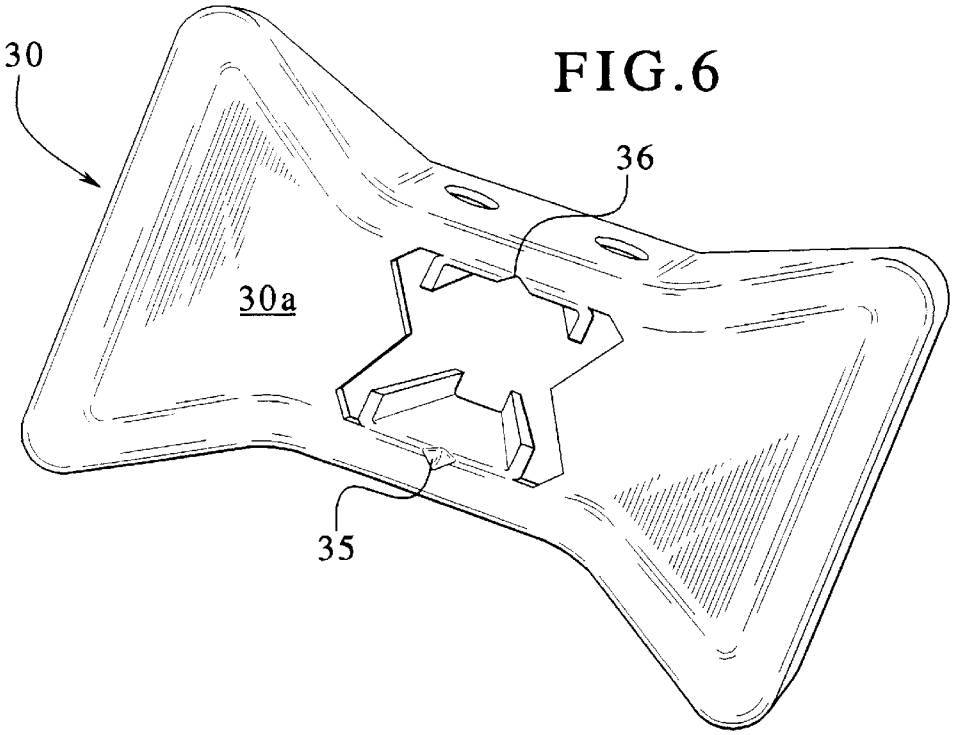
FIG. 6 is a perspective view from the bottom of the base of the scissors jack according to the invention.

FIG. 6 shows a perspective view from a bottom of the base 30 wherein support indents 35 and 36 can be seen having a partial pyramidal shape and which strengthen the tabs and resist lateral forces caused by the gear teeth against the flat surface 31*g*, 32*g* of the tabs.

Figure 7A:
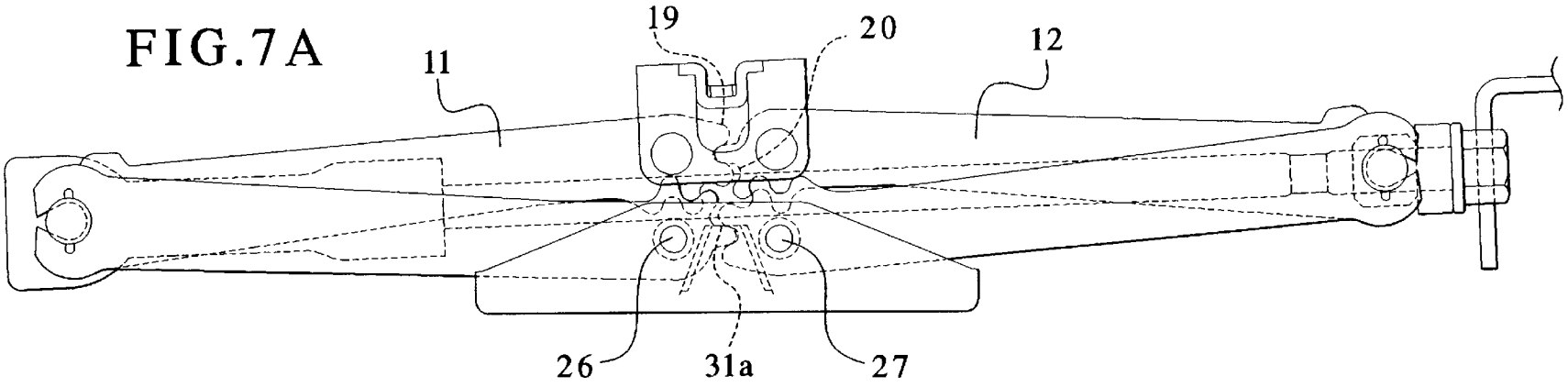
FIG. 7A is a side view of the jack of the invention in a fully lowered position.
Figure 7B:
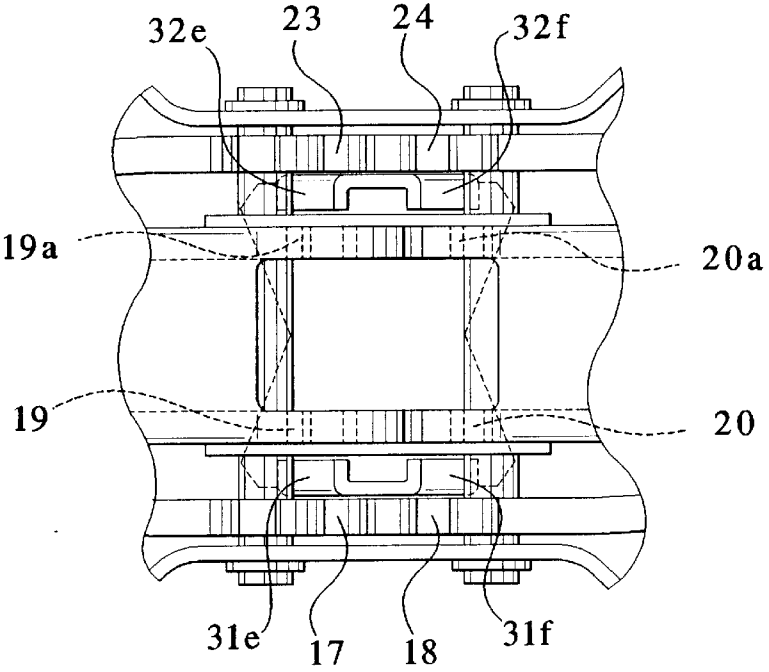
FIG. 7B is a top view of the base of the jack of the invention in the fully lowered position.

In the fully lowered position of the scissors jack shown in FIG. 7A in a side view and FIG. 7B in a top view, it can be seen that the teeth 19 and 20 on the upper channels 11 and 12 clear the top portion 31*a*, 32*a* of the tabs since the tabs are no higher than the top of the pins 26 and 27. Also, the width of the flanges 31*e*, 31*f* and 32*e*, 32*f* is slightly less than the spacing as viewed from the top in FIG. 7B between upper teeth 19, 20 and 19*a*, 20*a* and lower teeth 17, 18, and 23, 24.

As is evident from the construction of the support tabs 31 and 32, a stamping operation is provided so that material is stamped within the base surface 30*a* of the base 30 and is cut free to permit deformation of the tabs upwardly away from the base surface 30*a* and into their trapezoidal form shown most clearly in FIG. 5. As a result, a cutout portion 33 remains in the base having opposed pairs of inwardly extending edges 33*a*, 33*b* and 33*c*, 33*d* meeting at opposed points 33*e*, 33*f*.

With the present invention, tabs according to the disengagement prevention system of the invention can be manufactured with minimal cost and without use of additional materials since the material for the formation of the tabs comes from the base. Furthermore, the manufacturing operation cost is low by use of stamping methods and simple bending and forming methods.

Although various minor changes and modifications might be proposed by those skilled in the art, it will be understood that our wish is to include within the claims of the patent warranted hereon all such changes and modifications as reasonably come within our contribution to the art.

We claim as our invention:

1. A scissors jack, comprising:

first and second upper channels having first and second opposite ends and joined by first and second pivot pins to a load bearing member at said first ends;

first and second lower channels having first ends joined to said second ends of the first and second upper channels at third and fourth pivot pins, and second ends of the first and second lower channels opposite the first ends being joined by fifth and sixth pivot pins to a base having a floor portion and upwardly extending side walls between which the fifth and sixth pivot pins connect the first and second lower channels to the base;

gear teeth formed at the second ends of the first and second lower channels which intermesh at an engagement region between the fifth and sixth pivot pins, the first and second lower channels being U-shaped and having opposite side walls, and the gear teeth being formed on each of the lower channel side walls at the second ends;

a screw having one end received through an aperture at the third pivot pin and an opposite end being received in a threaded aperture connected with the fourth pivot pin;

first and second support tabs directly adjacent the lower channel gear teeth at said engagement region of the teeth at the second ends of the first and second lower channels so that the teeth in the engagement region are closely sandwiched between a flat supporting surface of the respective support tab and an inside of the respective side wall of the base so that misalignment of the teeth at the engagement region caused by high loads on the jack is substantially prevented; and the tabs being formed integrally from and with the floor portion of the base and are attached to the base floor portion at a bend which is substantially 90° upwardly from the base floor portion.

2. The scissors jack according to claim 1 wherein the support tabs have bent flanges extending from the flat support surface on each of the tabs in a direction away from the respective engagement region being sandwiched by the respective tab.

3. The scissors jack according to claim 1 wherein the support tabs each have a substantially trapezoidal shape with an upper edge being narrower than a base portion at the bend.

4. The scissors jack according to claim 1 wherein a top edge of the support tabs is positioned substantially between the fifth and sixth pivot pins at the base, a width of the top edge is less than a spacing between the fifth and sixth pivot pins, and the top edge terminates at a point no higher than a highest point on a central portion of the fifth and sixth pivot pins between the sidewalls of the base.

5. The scissors jack according to claim 1 wherein a cutout formed from the upwardly extending tabs is in the floor portion of the base.

6. The scissors jack according to claim 5 wherein the cutout has inwardly sloping side edges ending in respective points substantially at a middle of the cutout.

7. The scissors jack according to claim 1 wherein teeth are provided at the first ends of the first and second upper channels and wherein said teeth do not strike an upper edge of the support tabs when the scissors jack is in a fully collapsed position.

8. The scissors jack according to claim 1 wherein flanges are provided running along an outer edge of the opposite sidewalls of the lower channels at least at the second end of the lower channels and wherein said gear teeth are formed in said flanges.

9. A scissors jack, comprising:

first and second upper channels having first and second opposite ends pivotally connected to a load bearing member at said first ends;

first and second lower channels having first ends pivotally connected to said second ends of the first and second upper channels, and second ends of the first and second lower channels opposite the first ends being pivotally connected to a base having a floor portion and upwardly extending sidewalls;

gear teeth formed at the second ends of the first and second lower channels which intermesh at an engagement region, the first and second lower channels having opposite side walls, and the gear teeth being formed on each of the lower channel side walls at the second ends;

a screw rotatably connected between the pivotable connection of the lower channels to the upper channels; and first and second support tabs being a cut-out from and therefore integral with and bent upwardly from the floor portion of the base directly adjacent the lower channel gear teeth at said engagement region of the teeth at the second ends of the first and second lower channels so that the teeth in the engagement region are closely sandwiched between a flat supporting surface of the respective support tab and an inside of the respective side wall of the base.

10. A scissors jack, comprising:

first and second upper channels connected to a load bearing member, first and second lower channels connected to the first and second upper channels, the first and second lower channels also connecting to a base having a floor portion and respective side walls extending upwardly from the floor portion, and a screw connected between the connection of the upper channels to the lower channels for raising and lowering the scissors jack;

respective tabs extending upwardly from said floor portion of the base which are shaped and positioned for sandwiching engaging gear teeth of the respective first and second lower channels at the base between said respective sidewalls of the base and the respective tabs to prevent misalignment of the teeth where they engage when the scissors jack is being highly loaded; and the tabs being a stamped cut-out from said floor portion and being integral with and bent upwardly from said floor portion.

11. A scissors jack, comprising:

first and second upper channels having first and second opposite ends and joined by first and second pivot pins to a load bearing member at said first ends;

first and second lower channels having first ends joined to said second ends of the first and second upper channels at third and fourth pivot pins, and second ends of the first and second lower channels opposite the first ends being joined by fifth and sixth pivot pins to a base having a floor portion and upwardly extending side walls between which the fifth and sixth pivot pins connect the first and second lower channels to the base;

gear teeth formed at the second ends of the first and second lower channels which intermesh at an engagement region between the fifth and sixth pivot pins, the first and second lower channels being U-shaped and having opposite side walls, and the gear teeth being formed on each of the lower channel side walls at the second ends;

a screw having one end received through an aperture at the third pivot pin and an opposite end being received in a threaded aperture connected with the fourth pivot pin;

first and second support tabs directly adjacent the lower channel gear teeth at said engagement region of the teeth at the second ends of the first and second lower channels so that the teeth in the engagement region are closely sandwiched between a flat supporting surface of the respective support tab and an inside of the respective side wall of the base so that misalignment of the teeth at the engagement region caused by high loads on the jack is substantially prevented; and the support tabs have bent flanges extending from the flat support surface on each of the tabs in a direction away from the respective engagement region being sandwiched by the respective tab.

12. A scissors jack, comprising:

first and second upper channels having first and second opposite ends and joined by first and second pivot pins to a load bearing member at said first ends;

first and second lower channels having first ends joined to said second ends of the first and second upper channels at third and fourth pivot pins, and second ends of the first and second lower channels opposite the first ends being joined by fifth and sixth pivot pins to a base having a floor portion and upwardly extending side walls between which the fifth and sixth pivot pins connect the first and second lower channels to the base;

gear teeth formed at the second ends of the first and second lower channels which intermesh at an engagement region between the fifth and sixth pivot pins, the first and second lower channels being U-shaped and having opposite side walls, and the gear teeth being formed on each of the lower channel side walls at the second ends;

a screw having one end received through an aperture at the third pivot pin and an opposite end being received in a threaded aperture connected with the fourth pivot pin;

first and second support tabs directly adjacent the lower channel gear teeth at said engagement region of the teeth at the second ends of the first and second lower channels so that the teeth in the engagement region are closely sandwiched between a flat supporting surface of the respective support tab and an inside of the respective side wall of the base so that misalignment of the teeth at the engagement region caused by high loads on the jack is substantially prevented; and a cutout formed from the upwardly extending tabs in the floor portion of the base.

* * * * *